US007734206B2

(12) United States Patent
Ishida

(10) Patent No.: US 7,734,206 B2
(45) Date of Patent: Jun. 8, 2010

(54) IMAGE FORMING APPARATUS

(75) Inventor: Yusuke Ishida, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 212 days.

(21) Appl. No.: 12/046,711

(22) Filed: Mar. 12, 2008

(65) Prior Publication Data

US 2008/0232836 A1 Sep. 25, 2008

(30) Foreign Application Priority Data

Mar. 20, 2007 (JP) ..... 2007-071729

(51) Int. Cl.
*G03G 15/10* (2006.01)
*G03G 15/08* (2006.01)
*G03G 15/00* (2006.01)

(52) U.S. Cl. ..... 399/58; 399/27; 399/49; 399/63; 399/253

(58) Field of Classification Search ..... 399/31, 399/36, 49, 58, 159, 167
See application file for complete search history.

(56) References Cited

U.S. PATENT DOCUMENTS

| | | | | |
|---|---|---|---|---|
| 5,771,422 | A * | 6/1998 | Morihara | 399/50 |
| 7,010,237 | B2 | 3/2006 | Suzuki et al. | |
| 7,013,095 | B2 | 3/2006 | Ishida | |
| 7,027,746 | B2 | 4/2006 | Suzuki et al. | |
| 7,356,268 | B2 * | 4/2008 | Itoyama | 399/30 |
| 2002/0021923 | A1 * | 2/2002 | Sato et al. | 399/350 |
| 2006/0159474 | A1 | 7/2006 | Suzuki et al. | |
| 2007/0019989 | A1 * | 1/2007 | Nakamori | 399/159 |
| 2007/0177888 | A1 | 8/2007 | Ishida | |
| 2008/0075481 | A1 * | 3/2008 | Sugaya | 399/27 |

FOREIGN PATENT DOCUMENTS

| | | | |
|---|---|---|---|
| JP | 5-66678 | A | 3/1993 |
| JP | 2003-57939 | A | 2/2003 |
| JP | 2006-119380 | A | 5/2006 |

* cited by examiner

*Primary Examiner*—David M Gray
*Assistant Examiner*—Francis Gray
(74) *Attorney, Agent, or Firm*—Fitzpatrick, Cella, Harper & Scinto

(57) ABSTRACT

An image forming apparatus including an exposure device, a development device, an image density detection device, a supply device for supplying a toner to the development device, a cleaning device for cleaning the surface of an image bearing member, a driving torque detection device for detecting a driving torque of the image bearing member, and a controller which drives the image bearing member while providing a predetermined electric potential difference between a region charged in the image bearing member and a developer support in case of non-image formation conducts a driving torque detecting operation with respect to the image bearing member by means of the driving torque detection device, and changes a reference value in response to the value of the driving torque detected.

12 Claims, 15 Drawing Sheets

IMAGE FORMING APPARATUS

BACKGROUND OF THE INVENTION

1. Field of the Invention

The present invention relates to an image forming apparatus such as copying machines, and laser beam printers wherein there is applied electrostatic recording system or electrophotographic system in which the electrostatic image formed on an image bearing member is developed by the use of a developer containing a toner and a carrier.

2. Description of the Related Art

A two-component developer prepared by mixing principally a non-magnetic toner with a magnetic carrier is widely used (hereinafter referred to as "two-component developing system") as a developer used in an image forming apparatus due to the increase in quality and speed in full-color image forming apparatuses in recent years.

As a developing method wherein a two-component developer is used, there is a method wherein a developer containing a toner and a carrier is blended by means of a stirring/blending member, and the resulting blend is fed to the surface of a developer support. The developer support fixedly houses a magnetic roll in which a plurality of south poles and north poles are disposed alternately with each other, and the developer is in a condition wherein the developer forms a brush outline on the surface of the developer support by the magnetic force (hereinafter referred to as "magnetic brush"). Then, the developer magnetic brush supported on the surface of the developer support is allowed to be in contact with or to approach the surface of a photosensitive member, and a development bias voltage is applied between the developer support and the photosensitive member, whereby the toner is allowed to adhere onto an electrostatic image to complete the development.

In the case that a two-component developer is used in a reversal development system, an electrostatic force appears due to an electric potential difference between an image portion electric potential (V1 electric potential) and a development bias voltage (Vdc electric potential) applied on the developer support (hereinafter referred to as "development potential"). In the case that the electrostatic force is higher than that by which the carrier and the toner combine with each other, the toner leaves from the carrier. As a consequence, the toner adheres on the photosensitive member to effect the development.

At that time, such an electrostatic force which has a tendency to adhere onto the photosensitive member acts also by the electrostatic force due to the electric potential difference between the potential on the photosensitive member and the development bias voltage with respect to the carrier on the developer support. Consequently, the electrostatic force controls the electric potential on the surface of the photosensitive member and the developing bias voltage in such that the carrier stays on a development sleeve by means of the magnetic force of the developer support. Namely, in a normal state, the electrostatic force having the tendency wherein the carrier adheres onto the photosensitive member is the maximum in the surface potential area in a non-image portion (Vd electric potential) being an area charged; however, a higher magnetic force than the above-described electrostatic force is applied to the development sleeve, whereby it may be arranged in such that the carrier does not adhere to the photosensitive member.

On one hand, since a mixture ratio of a toner and a carrier in a development device (hereinafter referred to as "toner density") varies depending on the consumption of the toner in the development device in which a two-component developer is used, it is necessary to maintain always the toner density at an adequate level. In the case that the toner density is inadequate, there is a case where an inadequate image such as image density variation, fog, or beads carry over appears. For this reason, it is important to control properly the toner density in view of forming a high-quality and highly stabilized image. A control method for toner supply includes, for example, a method for applying toner density detection unit (toner density detection system) such as a light detection system or an inductance detection system, and a patch detection system (image density detection system).

The problems appeared in the case that the above-mentioned two-component development system is applied are described hereinafter.

In the case that the charge amount of a toner in a development device increases with the use of an image forming apparatus, the charging amount of a carrier due to the countercharge of the toner is increased accordingly. As a result, there is a case where the force due to an electric field increases more than the magnetic force of a magnetic roll, so that the carrier is developed in the non-image area on an electrostatic image retaining member, resulting in beads carry over. In the case that the beads carry over appears as described above, when a developed toner layer on a photosensitive member is transferred to a transfer material such as a paper in a transfer portion, the carrier is transferred in the condition wherein the carrier is developed on the paper as it stands, and it results in decrease in image quality. Furthermore, duration of life decreases due to damaging the surface of a photosensitive member in the case that the photosensitive member is cleaned by means of a cleaning member, besides decrease in image quality and decrease in duration of life occur due to streaks produced by damaging a cleaning member, a transfer device, or a fixing device.

Under the circumstances, there are technologies for solving the above-described problems (For example, see Japanese Patent Application (JP-A) Nos. 2006-119380, H05-66678, and 2003-57939).

In JP-A No. 2006-119380, there is proposed an image forming apparatus which detects the presence or absence of beads carry over on a photosensitive member by means of an optical sensor, and allows the photosensitive member to isolate from a transfer device based on the detection result. Other than that, there are proposed a variety of image forming apparatuses which detect the beads carry over on a photosensitive member by means of an optical detecting unit.

In JP-A No. H05-66678, there is proposed an image forming apparatus wherein an electromagnet is provided on the downstream side of the transfer direction of a photosensitive member, and the electromagnet being in a roller-shaped and adapted to be rotated attracts the carrier adhered on the photosensitive member to remove the carrier.

In JP-A No. 2003-57939, there is proposed that the occurrence of beads carry over is predicted in the case that a toner density detection result in a development device is lower than a certain threshold value to stop an image forming operation in the image forming apparatus wherein a toner density detection system such as an optical detection system, or an inductance detection system is applied.

However, the optical detection unit as disclosed in JP-A No. 2006-119380 exhibits poor detection accuracy of beads carry over, and further cannot detect the whole area of a photosensitive member in the main scanning direction thereof. Consequently, there are a variety of problems such that a carrier cannot be detected other than at the positions where optical sensors are provided, so that the proposed optical detection unit has been not useful.

The unit as disclosed in JP-A No. H05-66678 is a unit for only removing a carrier from a photosensitive member, there is a limit in the recovery capacity in the case that beads carry over increases further depending on a development condition, and consequently, there is also such a fear that the carrier adhered cannot be recovered. Besides, the unit does not suppress fundamentally beads carry over in a development device.

In addition, since the technique of JP-A No. 2003-57939 does not detect actual beads carry over, there is such fear that a large amount of beads carry over has already existed at the time when the image forming operation is stopped, so that the technique has not been useful.

SUMMARY OF THE INVENTION

Accordingly, the purpose of the present invention is to detect beads carry over with high accuracy and prevent such beads carry over.

To achieve the above purpose, an image forming apparatus comprises the followings: an image bearing member on which an electrostatic image is formed;

a development device which allows a developer containing a toner and a carrier to be supported on a developer support, whereby the electrostatic image is developed to form a toner image;

an image density detection device which detects a density of the image formed with the toner;

a supply device which supplies the toner to the development device based on the result of detection by the image density detection device;

a cleaning device provided in contact with the image bearing member to clean the surface of the image bearing member;

a driving device which drives the image bearing member;

a driving torque detection device which detects the driving torque in case of driving the image bearing member; and a controller which controls the toner concentration in the developer by means of the supply device in response to a value of the driving torque so as to suppress the transition of the carrier to the image bearing member.

According to another aspect of the invention, an image forming apparatus may comprise an image bearing member on which an electrostatic image is formed;

a development device which allows a developer containing a toner and a carrier to be supported on a developer support, whereby the electrostatic image is developed to form a toner image;

a toner density detection device which detects a toner density of the developer in the development device;

a supply device which supplies the toner to the development device based on the result of detection by the toner density detection device;

a cleaning device provided in contact with the image bearing member to clean the surface of the image bearing member;

a driving device which drives the image bearing member;

a driving torque detection device which detects the driving torque in case of driving the image bearing member; and a controller which controls the toner concentration in the developer by means of the supply device in response to a value of the driving torque so as to suppress the transition of the carrier to the image bearing member.

To achieve the above purpose, an image forming apparatus comprises the followings: a charging device which charges an image bearing member;

an exposure device which exposes a region charged in the image bearing member being charged by the charging device to form an electrostatic image;

a development device which allows a developer containing a toner and a carrier to be supported on a developer support, and which provides an electric potential difference between the developer support and the electrostatic image, whereby the electrostatic image is developed to form a toner image;

a cleaning device provided in contact with the image bearing member to clean the surface of the image bearing member;

a driving device which drives the image bearing member;

a driving torque detection device which detects the driving torque in case of driving the image bearing member; and a controller which drives the image bearing member while providing a predetermined electric potential difference between the region charged in the image bearing member and the developer support in case of non-image formation, conducts a driving torque detecting operation with respect to the image bearing member by means of the driving torque detection device, and changes the electric potential difference between the region charged in the image bearing member and the developer support in case of image formation in response to the value of the driving torque detected so as to suppress the transition of the carrier to the image bearing member.

Further features of the present invention will become apparent from the following description of exemplary embodiments (with reference to the attached drawings).

DESCRIPTION OF THE EMBODIMENTS

In the following, an image forming apparatus according to the present invention is described in more detail by referring to the accompanying drawings.

First Embodiment

A first embodiment of the invention is described in reference to the accompanying drawings.

(Image Forming Apparatus)

Figure 1:
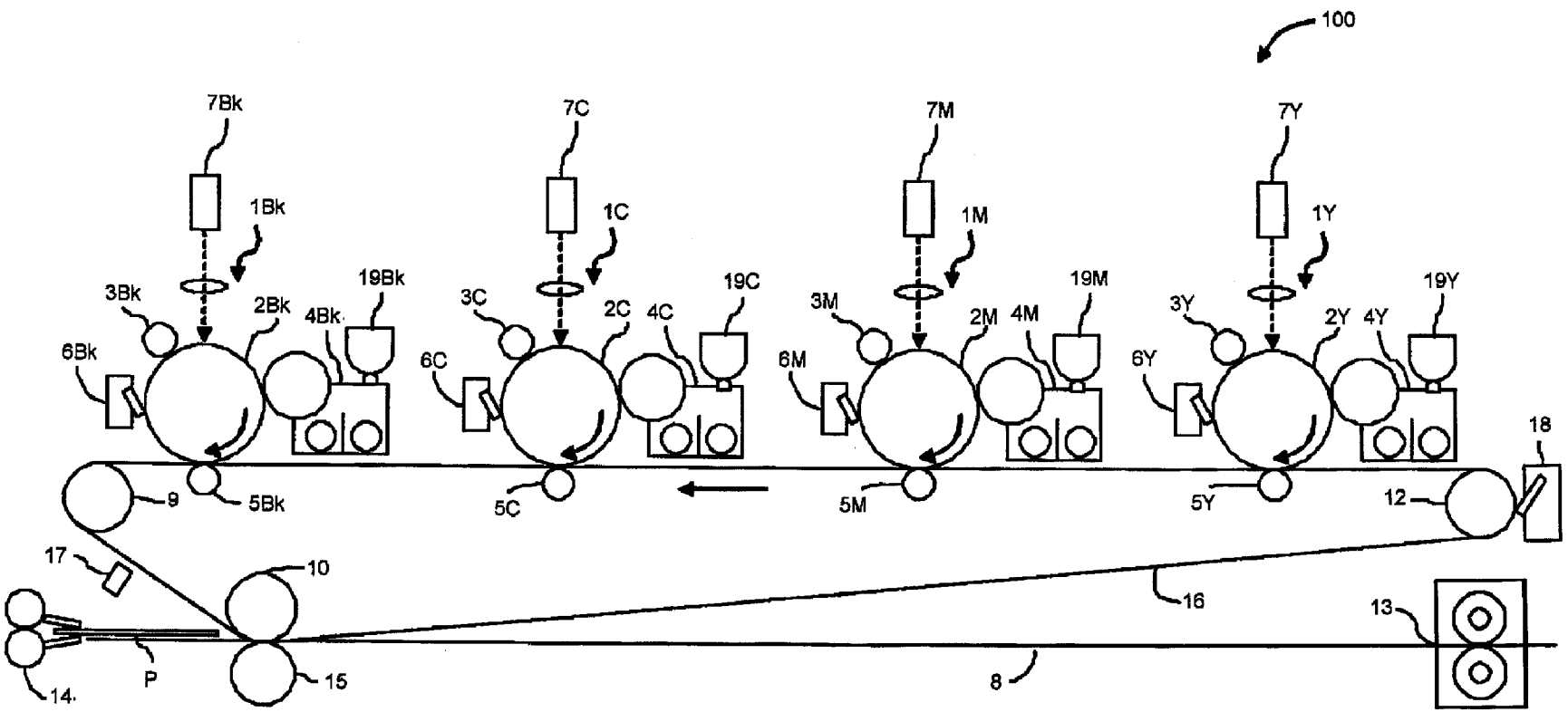
FIG. 1 is a schematic constitutional view illustrating an example of an image forming apparatus.

First, the whole constitution and the operations of the image forming apparatus of the present embodiment are described. FIG. 1 is a schematic constitutional view showing an image forming apparatus 100 of the present embodiment. The image forming apparatus 100 is an electrophotographic system full-color printer having four image forming sections 1Y, 1M, 1C, and 1Bk provided corresponding to four colors of yellow, magenta, cyan, and black.

The image forming apparatus 100 may form a four full-color image on a recording material (recording paper, plastic film, cloth etc.) in response to an image signal from host equipment. The host equipment means herein an original scanning device (not shown) connected to an image forming apparatus main body, a personal computer connected to be able to communicate with the image forming apparatus main body, or the like equipment.

It is constituted in such that toner images formed on electrophotographic photosensitive members (photosensitive drums 2Y, 2M, 2C, and 2Bk) as image bearing members in the respective image forming sections 1Y, 1M, 1C, and 1Bk are transferred onto an intermediate transfer belt 16, and the images are subsequently transferred onto a recording material P conveyed by a recording material support 8. In the following, the embodiment is fully described. It is to be noted that the four image forming sections 1Y, 1M, 1C, and 1Bk included in the image forming apparatus 100 have substantially the same constitution as that of the others except that the development colors thereof. Accordingly, the symbols Y, M, C, and Bk representing only the colors of the image forming sections are omitted, and the description for the image forming sections is generically made so far as the distinction therefor is not particularly required.

The image forming section 1 is provided with a cylindrical type photosensitive member, i.e. a photosensitive drum 2 as the image bearing member. The photosensitive drum 2 is rotary driven in the direction of the arrow in the drawing.

Around the photosensitive drum 2, there are provided a charging roller 3 being a charging unit, a development device 4 being a developing unit, a primary transfer roller 5 being a transfer unit, and a cleaning device 6 being a cleaning unit. The cleaning device 6 is provided with a cleaning blade being in contact with the photosensitive drum, and the surface of the photosensitive drum is cleaned by the cleaning blade. A laser scanner (exposure device) 7 being an exposure unit is positioned over the photosensitive drum 2 in the upper direction of the drawing.

An intermediate transfer belt 16 is disposed in opposite to the photosensitive drum 2 of the respective image forming sections 1. Furthermore, a secondary transfer roller 15 and a secondary transfer counter roller 10 are disposed under the four photosensitive drums 2 so as to sandwich the intermediate transfer belt 16 and the recording material support 8.

The intermediate transfer belt 16 is stretched by a driving roller 9, the secondary transfer counter roller 10, and a tension roller 12. The intermediate transfer belt 16 is driven by the driving roller 9 to revolvingly travel in the direction of the arrow in the drawing thereby to convey a toner image to an abutting section upon the recording material P. In succession, the toner image is transferred to the recording material P from the intermediate transfer belt 16; thereafter the toner image is heat-fused on the recording material P by means of a fuser 13.

The operations of four full-color image formation are exemplified and described.

First, when the image formation operation begins, the surface of the rotating photosensitive drum 2 is uniformly charged by the charging roller 3. At this time, a charging bias is applied to the charging roller 3 from a charging bias power source. Then, the photosensitive drum 2 is exposed by laser beams in response to image signals generated from the exposure device 7. As a consequence, the electrostatic image in response to the image signals is formed on the photosensitive drum 2. The electrostatic image on the photosensitive drum 2 is visualized with the toner contained in the development device 4 to obtain a visual image. In the present embodiment, reversal development system wherein a toner is allowed to adhere to a bright portion potential exposed by laser beams is applied.

A toner image is formed on the photosensitive drum 2 by means of the development device 4, and the toner image is transferred primarily to the intermediate transfer belt 16. The toner left on the surface of the photosensitive drum 2 (transfer residual toner) after the primary transfer is removed by the cleaning device 6.

The operation as described above is successively carried out in respect of four color toners of yellow, magenta, cyan, and black, and the four color toner images are superposed on the intermediate transfer belt 16 one another. Thereafter, the recording material P contained in a recording material containing cassette (not shown) is conveyed in proper timing with the formation timing of the toner image by means of supply rollers 14 and the recording material support 8. Then, a secondary transfer bias is applied to a secondary transfer roller 15, whereby the four-colored toner image on the intermediate transfer belt 16 is transferred secondarily in a lump onto the recording material P supported on the recording material support 8.

Then, the recording material P is separated from the photosensitive drum, and conveyed to the fuser 13 being a fixing unit. When the toners are heated and pressurized by the fuser 13, the toners on the recording material P are fused and mixed to obtain a full-colored permanent image. Thereafter, the recording material P is discharged outside the apparatus.

The toner left on the intermediate transfer belt 16 which has not been completely transferred in the secondary transfer section is removed by an intermediate transfer belt cleaner 18, and consequently, a series of operations is completed.

It is to be noted that a desired unicolored or multicolored image can be formed by using only a desired image forming section or image forming sections in the present embodiment.

(Development Device and Toner Supply Device)

Figure 2:
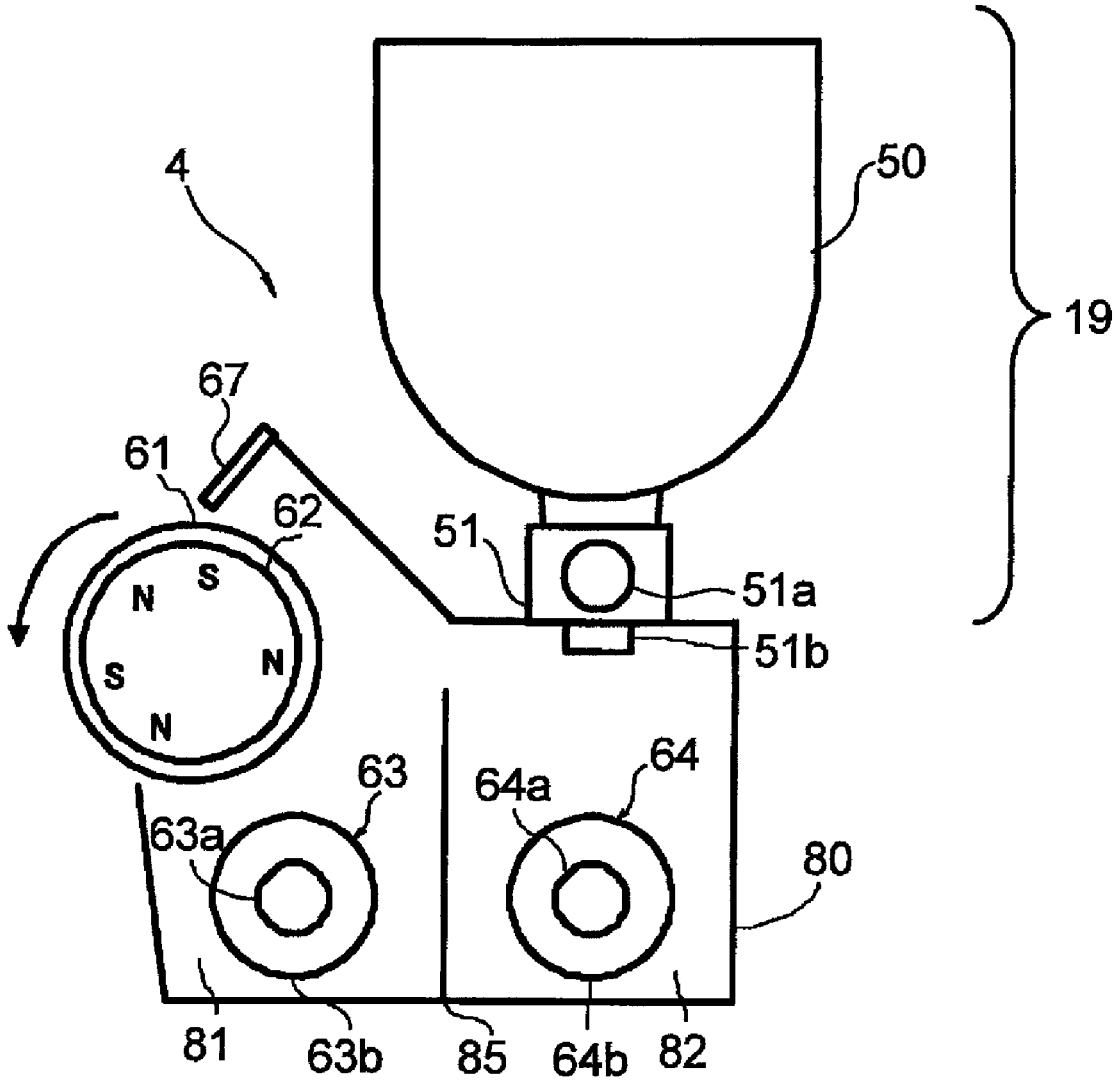
FIG. 2 is an explanatory view for describing a development device and a toner supply device.
Figure 3:
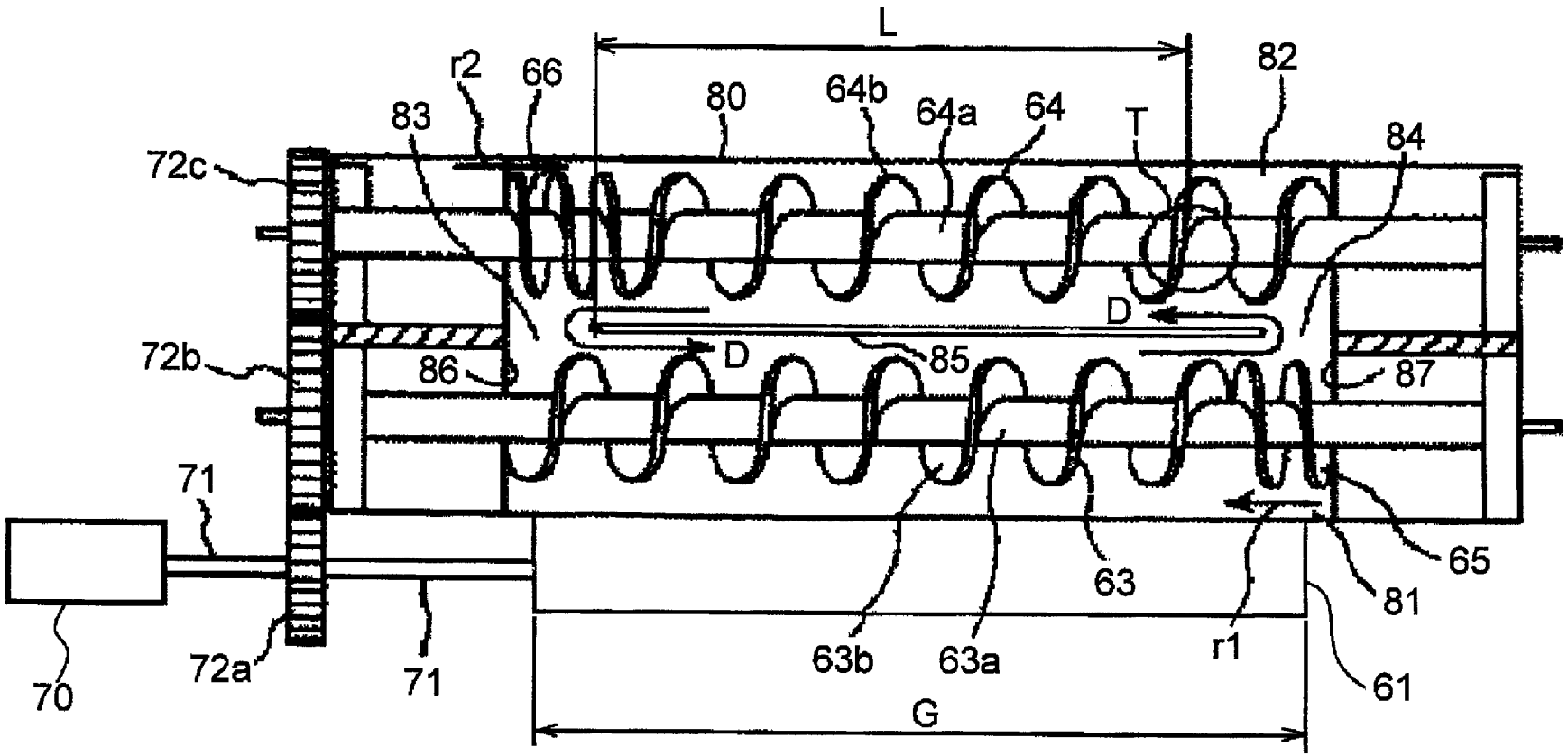
FIG. 3 is an explanatory view for describing the development device.

Next, the development device 4 and the toner supply device 19 are described by referring to FIGS. 2 and 3. In the present embodiment, the constitutions of yellow, magenta, cyan, and black development devices and toner supply devices are the same as that of the others one another.

As shown in FIG. 2, the development device 4 has a developer container 80 containing a developer. A two-component developer including principally a nonmagnetic toner (toner) and a magnetic carrier (carrier) as the developer is contained in the developer container 80. A toner density of the developer in the initial condition is 7% by weight in the present embodiment. However, the value should be appropriately adjusted depending upon the charging amount of a toner, the particle diameter of a carrier, the constitution of an image forming apparatus and the like. Accordingly, it is not necessarily to follow the numerical value as described above. The target value of an adequate toner density is referred to as "toner density target value" in the present embodiment.

A part opposed to the photosensitive drum 2 of the development container 80 is opened, and a development sleeve 61 being a developer support is rotatably disposed so as to partly expose with respect to the opening. The development sleeve 61 is made of a nonmagnetic material, and involves a stationary magnet 62 being a magnetic field generation unit. In the present embodiment, the magnet 62 has a plurality of magnetic poles along the outer circumference thereof. In case of a developing operation, the development sleeve 61 rotates in the direction of the arrow in the drawing to maintain the two-component developer in the development container 80 in the form of laminate, and supports and conveys the developer to a development region opposed to the photosensitive drum 2. The developer supported on the development sleeve 61 forms a magnetic brush in the development region. Then, the magnetic brush is either allowed to be in contact with or close to the surface of the photosensitive drum 2 to supply the toner in the two-component developer in response to the electrostatic image to be formed on the surface of the photosensitive drum 2 thereby to develop the electrostatic image.

In general, a predetermined development bias is applied to the development sleeve 61 in case of at least developing operation, whereby the toner is shifted to the photosensitive drum 2 by the action of the electric field generated between the photosensitive drum 2 and the development sleeve 61. In order to restrict an amount of the developer supported on the development sleeve 61, a developer amount restriction unit 67 for restricting a thickness of a developer layer by the action of a magnetic field in cooperation with the magnet 62 is provided on the more upstream side in the rotating direction of the development sleeve 61 than the development region.

The remaining developer after developing the electrostatic image on the photosensitive drum 2 is conveyed in accordance with the rotation of the development sleeve 61, and recovered in a development chamber (first developer containment chamber) 81, which will be described hereunder, of the development container 80.

As shown in FIG. 3, the development container is divided by a partition wall 85 into substantially two parts of the development chamber 81 (the side close to the development sleeve 61) and an agitation chamber (second developer containment chamber) 82 (the side distant from the development sleeve 61). The development chamber 81 and the agitation chamber 82 extend in the axial direction of the development sleeve 61 in the present embodiment. The partition wall 85 does not reach the opposed end portions in the longitudinal direction inside the development container 80, i.e. side walls 86 and 87, whereby a first communication portion 83 and a second communication portion 84 permitting a developer to pass through both the development chamber 81 and the agitation chamber 82 are formed.

The development chamber 81 and the agitation chamber 82 are provided with a circulation unit for circulating a developer therebetween. The circulation unit has a first screw 63 and a second screw 64 along the longitudinally axial direction of the development chamber 81 and the agitation chamber 82 as convey members convey and agitate the developer, respectively. Thus, the developer is blended and agitated while circulating in the development container 2 by the first screw 63 and second screw 64. The direction of circulating the developer in the development device 4 of the present embodiment is the direction from the back side of FIG. 2 towards the front side thereof in the development chamber 81, while it is the direction from the front side of FIG. 2 towards the back side thereof in the agitation chamber 82 (the directions of the arrows D in FIG. 3).

In the development device 4 of the present embodiment, the driving force from a driving source 70 being a driving motor provided on the image forming apparatus main body is transmitted to the development sleeve 61 through a revolving shaft 71 being a drive transmission unit. Furthermore, the driving force is transmitted to the first screw 63 and the second screw 64 through a gear system of 72*a*, 72*b*, and 72*c* being a drive transmission unit.

The first screw 63 and the second screw 64 have revolving shafts 63*a* and 64*a* disposed substantially in parallel to the longitudinally axial direction of the development chamber 81 and the agitation chamber 82, and spirally shaped convey portions (blade portions, spiral members) 63*b* and 64*b* provided around the each revolving shafts, respectively. In the present embodiment, both the first and the second screws 63 and 64 have the revolving shafts 63*a* and 64*a* each having 6 mm axial diameter; and the spirally shaped convey portions 63*b* and 64*b* each having 16 mm diameter are provided with 15 mm interval on the axial circumferences of the revolving shafts, respectively.

In the present embodiment, there are a first return member 65 and a second return member 66 on the downstream end portions in the convey directions of a developer in the first screw 63 and the second screw 64, respectively. Namely, the return member 65 and the return member 66 are formed with the spirally shaped convey portions (blade portions) on the axial circumferences of the revolving shafts 63*a* and 64*a*, respectively. The first return member 65 is coaxially provided on the first screw 63 so as to reverse the convey direction of the developer (the direction of the arrow r1 in the drawing), while the second return member 66 is coaxially provided on the second screw 64 so as to reverse the convey direction of the developer (the direction of the arrow r2 in the drawing).

Hence, the developer is returned in the reverse directions against the convey directions (the directions D of the arrows in FIG. 3) in the respective downstream end portions in the convey directions of the developer in the first screw 63 and the second screw 64, whereby the developer is smoothly delivered and received in the first communication portion 83 and the second communication portion 84, respectively.

The toner in a two-component developer is consumed by the above-mentioned developing operation. Consequently, the toner density in the developer contained in the developer container 80 decreases gradually. Accordingly, a toner is supplied to the developer container 80 by means of the toner supply device 19 shown in FIG. 2. The toner supply device 19 has a toner container (toner supply tank, toner storage section) 50 containing the toner to be supplied to the development device 4. The toner container 50 is provided with a toner supply port 51*b*. The toner container 50 is further provided with a toner supply screw 51*a* being a toner supply unit for conveying the toner towards the toner supply port 51*b*.

(System for Controlling Toner Density)

When an image formation operation is repeated, the toner in the developer container 2 is consumed and the toner density in a developer is decreased. Accordingly, it is required to control the toner density within a desired range by supplying properly the toner.

In the present embodiment, a system using two systems at the same time is applied in order to control the toner density within a desired range. One of which is a video count system, and the other is a patch detection system. The video count system is a system wherein a time of revolution of the toner supply screw 51*a* is controlled based on the video count number of the density signal in an image information signal. On the other hand, the patch detection system is a control system wherein first, a reference toner image (patch image) is formed on the photosensitive drum 2, the resulting reference toner image is transferred onto the intermediate transfer belt 16, and then, the density signal of the patch image is detected by the optical sensor 17 being an image density detection unit. The optical sensor 17 detects the quantity of reflected light as a density signal in the case that the patch image is illuminated by a light. The density signal is then compared with the initial reference signal which has been stored previously, and the driving time of the toner supply screw 51*a* which is determined by a first toner supply control unit is compensated based on the comparison data.

In such combined system as described above, a toner density is controlled principally by the video count system. In the video count system, the level of the output signal in an image signal processing circuit is counted in every pixel, and when the count number is integrated by pixels of an original paper size, the video count number per an original is determined. For example, the maximum video count number in an A4 size original is 3884×106 in 400 dpi and 256 gradation sequence.

The video count number corresponds to a prospective amount of toner consumption, thus, an appropriate time of rotation of the toner supply screw 51*a* is determined from the conversion table indicating a correspondence relationship between the video count number and the time of rotation of the toner supply screw 51*a*, and the toner is supplied accordingly.

In the present embodiment, a system wherein the time of rotation of the toner supply screw 51*a* is selected only among integral multiples of the prescribed unit time which has been previously determined (unit block supply) is applied.

Figure 4:
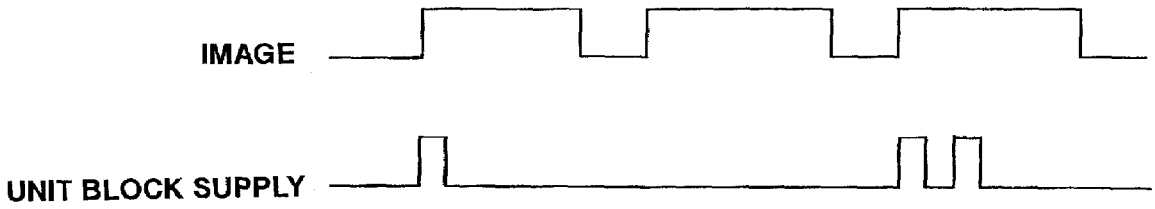
FIG. 4 is a diagram for describing the state of unit block supply.

Namely, the time of rotation of the toner supply screw 51*a* per 1 unit block is set in 0.4 second in the present embodiment. Accordingly, the time of rotation of the toner supply screw 51*a* per an image is limited to 0.4 second or the integral multiples thereof. FIG. 4 shows the state of a specific toner supply.

For instance, it is assumed that the time of rotation of the toner supply screw 51*a* determined by means of the conversion table from the above-described video count number is 0.52 second. In this case, the number of the unit block supply supplied per an image in the next image forming operation is one (the time of rotation of the toner supply screw 51*a* is 0.4 second). In this condition, the toner supply of the remaining 0.12 second is stored as a remainder. The remainder is added to the time of rotation of the toner supply screw 51*a* determined from the next video count numbers. The flow of the above-described processing is shown in FIG. 5.

Figure 5:
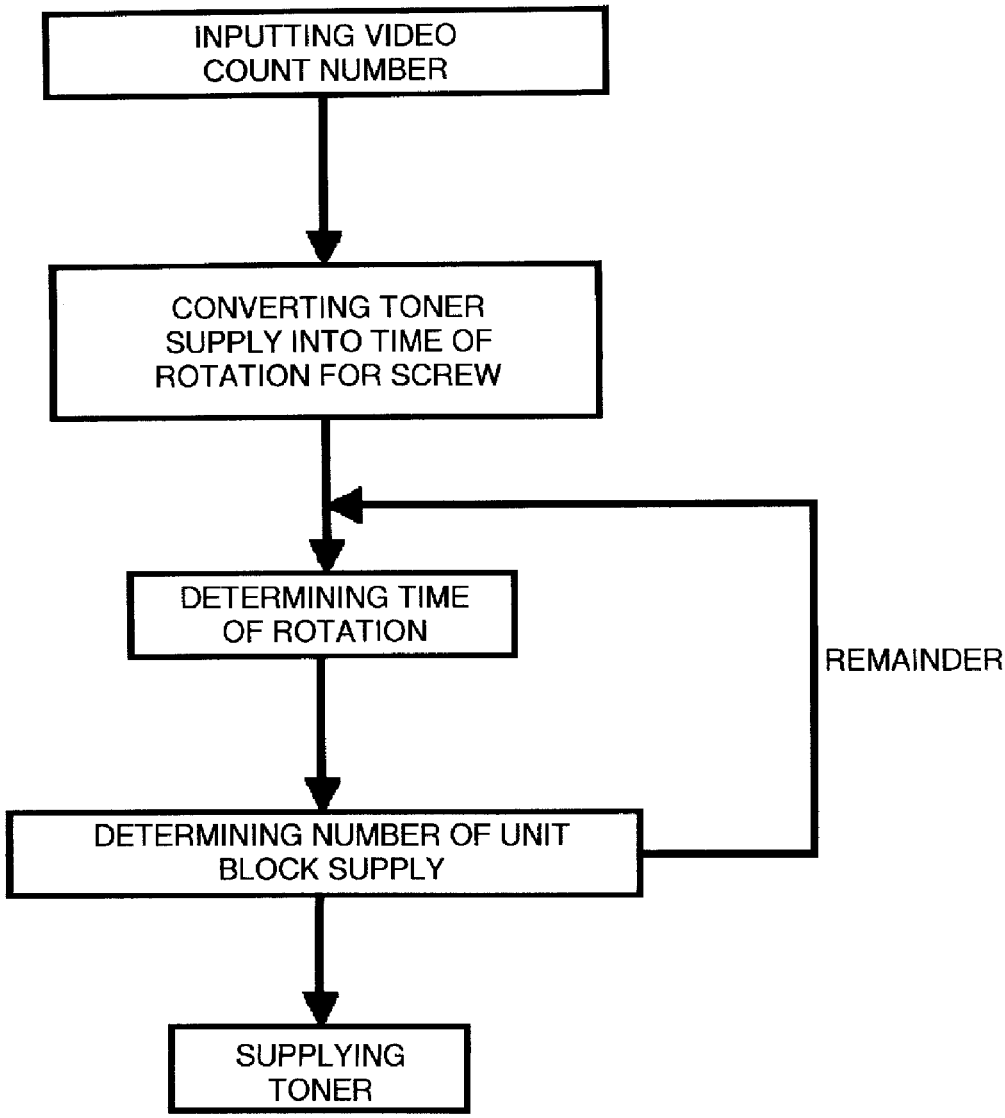
FIG. 5 is a flowchart for describing the toner supply according to a video counting system.

As shown in FIG. 5, the advantage obtained by limiting the time of rotation of the toner supply screw 51*a* to only the integral multiples of a predetermined unit time is in that the amount of a toner supply in each time is stabilized.

When a toner is supplied in accordance with the time of rotation of the toner supply screw 51*a* determined from a video count number as it stands, the time of rotation becomes very short in the case that the video count number is small. In the case that the time of rotation is short, there is such a problem that the influences of the rise time and the fall time of the driving motor which drives the toner supply screw 51*a* increase, so that the amount of toner supply is not stabilized.

Thus, when a constant time of rotation maintains always as in the present embodiment, the amount of toner supply is stabilized.

When there is a deviance between the amount of expected toner consumption and the amount of actual toner consumption, a developer density departs gradually from an appropriate range in the video count system. For this reason, the compensation of the amount of toner supply is applied in a predetermined interval using a patch detection system (hereinafter referred to as "patch detection mode"). In the present embodiment, the interval is set up in every 30 pieces of a small size original (for example, A4 lengthwise).

When the number of image formation reaches 50 pieces and is in the operation timing of a patch detection mode, the electrostatic image of a patch image having a certain area is formed on the photosensitive drum 2. The electrostatic image is developed by a predetermined development contrast voltage to obtain the patch image. Then, the patch image is transferred onto the intermediate transfer belt 16, and thereafter, the density signal thereof is detected by the optical sensor 17 being an optical density detection unit which is opposed to the intermediate transfer belt 16. The density signal Vsig is compared with the reference signal Vref which has been stored previously in a memory.

In case of $Vsig-Vref \leqq 0$, it is judged that the density of the patch image is low, i.e. the developer density is low. Then, a required amount of toner supply and the time of rotation of the toner supply screw are determined from the difference between the Vref and the Vsig. Hence, the compensation is made in such a fashion that the time of rotation is added to the time of rotation determined by the video count system.

In case of $Vsig-Vref \geqq 0$, it is judged that the density of the patch image is high, i.e. the developer density is high. Then, the unnecessary amount of toner and the stop time of the toner supply screw 51*a* in response to the unnecessary amount of toner are determined from the difference between the Vref and the Vsig. Hence, the compensation is made in such a fashion that the time determined is subtracted from the time of rotation determined by the video count system.

Figure 6:
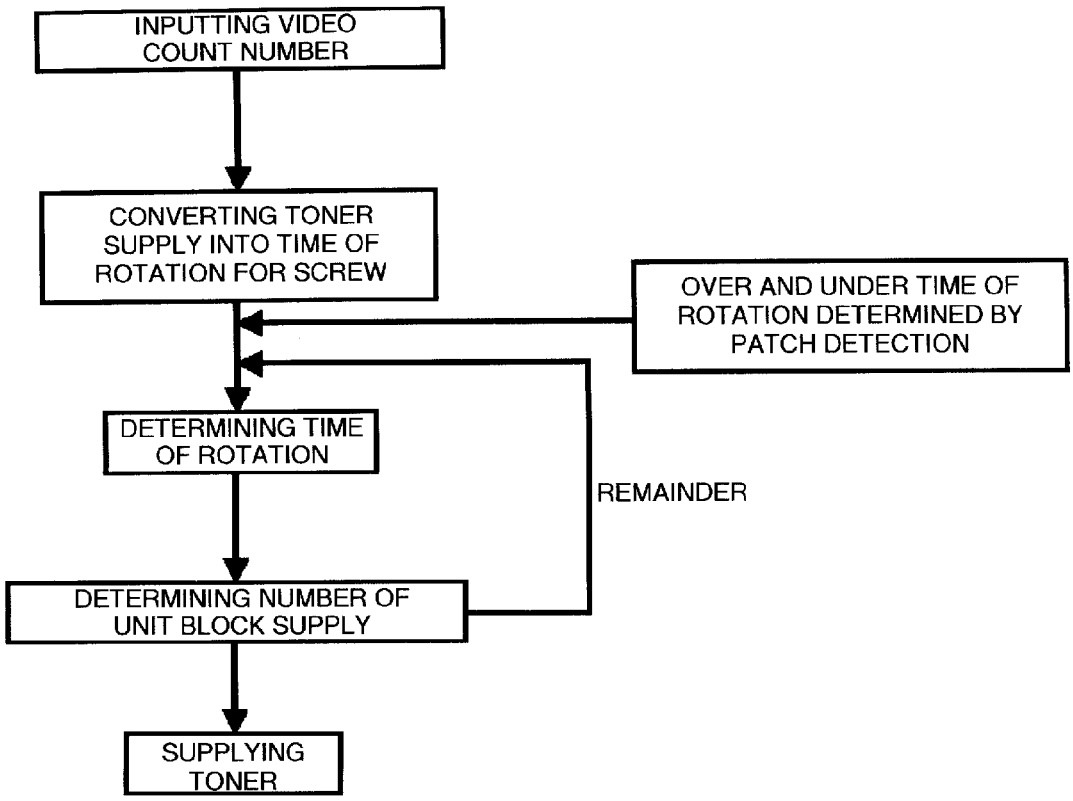
FIG. 6 is a flowchart for describing the toner supply in the case that a video counting system is used together with a patch detection system.

As described above, it is controlled in such that the density target value of the patch image is made to be higher in the case that the Vsig is less than the Vref, while it is controlled in such that the density target value of the patch image is made to be lower in the case that the Vsig is more than the Vref, whereby the deviance in toner density can be compensated. The flow of processing in case of the combined use of the video count system and the patch detection system is shown in FIG. 6.

Figure 7:
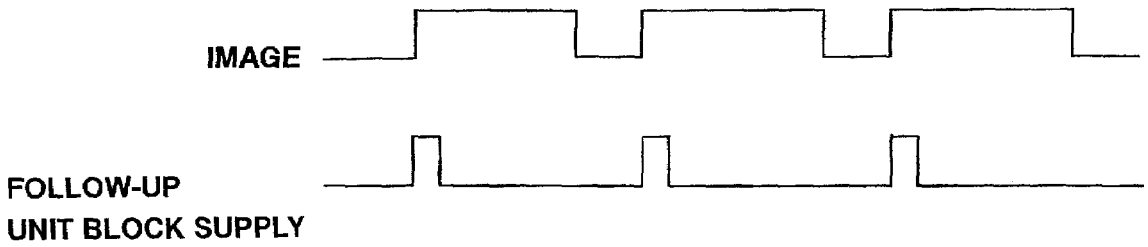
FIG. 7 is a diagram for describing such fact that a follow-up manner of the number of unit block supply differs in the case that the density signal of a patch image is in a predetermined value or less from the case that the density signal of the patch image is more than the predetermined value.

In the case that the time of rotation of the toner supply screw 51*a* is allowed to increase from the detection result of the patch detection mode, i.e. in the case that the number of unit block supply is added, it is arranged in such that only 1 block per a piece of image is added as shown in FIG. 7.

Namely, in the case that 10 blocks of the number of unit block supply are added from the detection result of the patch detection mode, 10 blocks are not added at once, but it is arranged in such that 1 block each per a piece of image is added, so that the additional compensation is completed by applying 10 pieces or more of images. When such control processing is conducted, the appearance of fog or scattering due to rapid increase of the toner density in the development device can be suppressed.

(Developer)

The developer used in the present embodiment is described hereinafter. As mentioned above, a two-component developer including principally a nonmagnetic toner (toner) and a magnetic carrier (carrier) is used in the present embodiment.

The toner includes a binder resin, colorant, colored resin particles containing the other additives according to need, and colored particles to which an external additive such as a colloidal silica impalpable powder is externally added. The toner is a negatively charged polyester base resin manufactured by a crushing method, and the volume average particle diameter thereof is preferably 5 μm or more and 9 μm or less. In the present embodiment, the volume average particle diameter is 6.2 μm.

For the carrier, iron with an oxidized surface or a surface without oxidize, a metal such as cobalt, manganese, chromium, and rare earths, the alloys thereof, or the oxide ferrites may be preferably used. A manufacturing method for these magnetic particles is not particularly restricted. A weight average particle diameter of the carrier is 20 to 50 μm, and preferably 30 to 40 μm. An electric resistivity of the carrier is $10^7$ Ωcm or more, and preferably $10^8$ Ωcm or more. In the present embodiment, a carrier having $10^8$ Ωcm electric resistivity is used.

A volume average particle diameter of the toner used in the present embodiment is measured by means of the following devices and method. As measuring instruments, Coulter counter type TA-II (manufactured by Coulter Electronics Ltd.), an interface for outputting a number-average distribution and a volume-average distribution (manufactured by Nikkaki Co.), and a CX-I personal computer (manufactured by Cannon Inc.) are used. 1% NaCl aqueous solution prepared by using first grade sodium chloride is used as an electrolytic aqueous solution. The measuring method is as follows. 0.1 ml of a surfactant, preferably alkylbenzene sulfonate is added as a dispersant to 100 to 150 ml of the above-described electrolytic aqueous solution, and to which 0.5 to 50 mg of a sample to be measured is added. The electrolytic aqueous solution into which the sample is suspended is subjected to dispersion treatment by an ultrasonic disperser for about 1 to 3 minutes, and the particle size distribution is measured as to particles of 2 to 40 μm with the use of 100 μm aperture as an aperture by means of the above-described Coulter counter type TA-II, whereby a volume average distribution is determined. From the volume average distribution thus obtained, a volume average particle diameter is obtained.

(Image Forming Operation)

Figure 8:
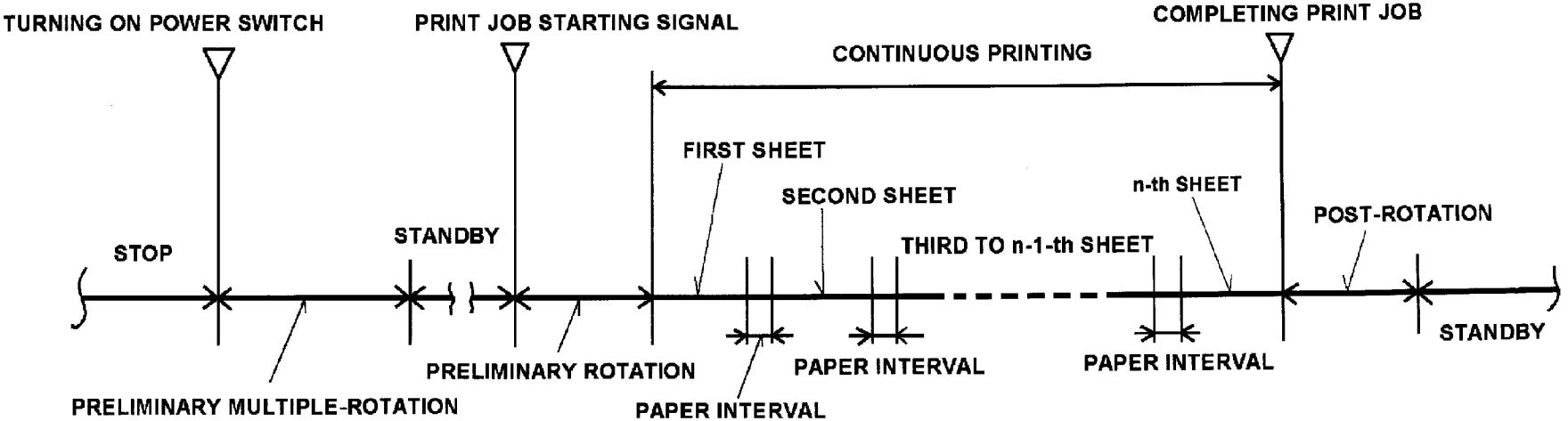
FIG. 8 is a diagram for describing the operation steps of an image forming apparatus.

The operation process chart of the above-described image forming apparatus is illustrated in FIG. 8.

a: Preliminary Multiple-Rotation Process

The process corresponds to a in a start-up (activation) operation period (warming period) of the image forming apparatus. The main power source switch of the image forming apparatus is turned ON to start up the main motor of the image forming apparatus, whereby the preparatory operation of required process equipment is implemented.

b: Standby

After completing the predetermined start-up operation period, the driving of the main motor is stopped, and the image forming apparatus is kept in a standby (waiting) condition until a print job start signal is input.

c: Preliminary Rotation Process

The process corresponds to a period wherein the main motor is driven again based on inputting a print job start signal to implement preliminary operations of the print job of required process equipment. More practically, the process is conducted in the order of the following steps: 1. the image forming apparatus receives the print job start signal, 2. the image is developed by a formatter (the developing time varies depending on the data amount of the image or the processing speed of the formatter), and 3. the preliminary rotation process starts. In the case that the print job start signal has been already input during the above-described step 1. of the preliminary multiple-rotation process, the step shifts succeedingly to the preliminary rotation process after completing the preliminary multiple-rotation process without accompanying the above-described step 2. of the standby.

d: Print Job Implementation

When the predetermined preliminary rotation process is completed, succeedingly, the image formation process is implemented to output a recording material on which an image has been formed. In case of continuous print job, the image formation process is repeated to output successively a required number of recording materials on each of which the image has been formed.

e: Paper Interval Process

In case of continuous print job, the process corresponds to that for an interval as to the rear end of a recording material P and the front end of the following recording material P, and it means a period for the condition wherein a paper does not pass through in a transfer section or a fuser.

f: Post-Rotation Process

The main motor is driven continuously for a predetermined period of time either after outputting a recording material on which an image has been formed in case of the print job for only a piece of the recording material, or after outputting the last recording material on which an image has been formed in a continuous print job in case of implementing the continuous print job. The process corresponds to a period for implementing a post-operation of the print job for required process equipment by the above operation.

g: Standby

After completing the predetermined post-rotation process, driving of the main motor is stopped, and the image forming apparatus is maintained in a standby (waiting) condition until the following print job start signal is input.

In the above-mentioned case, the implementing a print job period in process d is the period of forming an image, while the preliminary multiple-rotation process period in process a, the preliminary rotation process period in process c, the paper interval process period in process e, and the post-rotation process period in process f are the periods of non-image formation. Namely, the case of non-image formation means at least one case of the above-described cases of preliminary multiple-rotation process, preliminary rotation process, paper interval process, and post-rotation process, and it consequently means predetermined periods of time in the process (processes).

In the case of the above-mentioned non-image formation, a predetermined voltage is applied to the charging roller 3 and the development sleeve 61 while at least the photosensitive drum 2 and the development sleeve 61 are rotated. Thus, a prescribed electric potential difference (electric potential Vback) is maintained between the photosensitive drum 2 and the development sleeve 61. This is because the photosensitive drum 2 and the development sleeve 61 are rotated in case of non-image formation, whereby the appearance of fog and beads carry over is prevented. Specifically, it is arranged in the present embodiment that the surface electric potential (electric potential Vd) of the photosensitive drum 2 is −500 V, a development bias voltage (Vdc) is −300 V, and an electric potential Vback is 200 V.

(Detection Operation of Driving Torque and Control Thereafter)

Next, the detection of a driving torque of the photosensitive drum 2 in the present embodiment is described.

Figure 9:
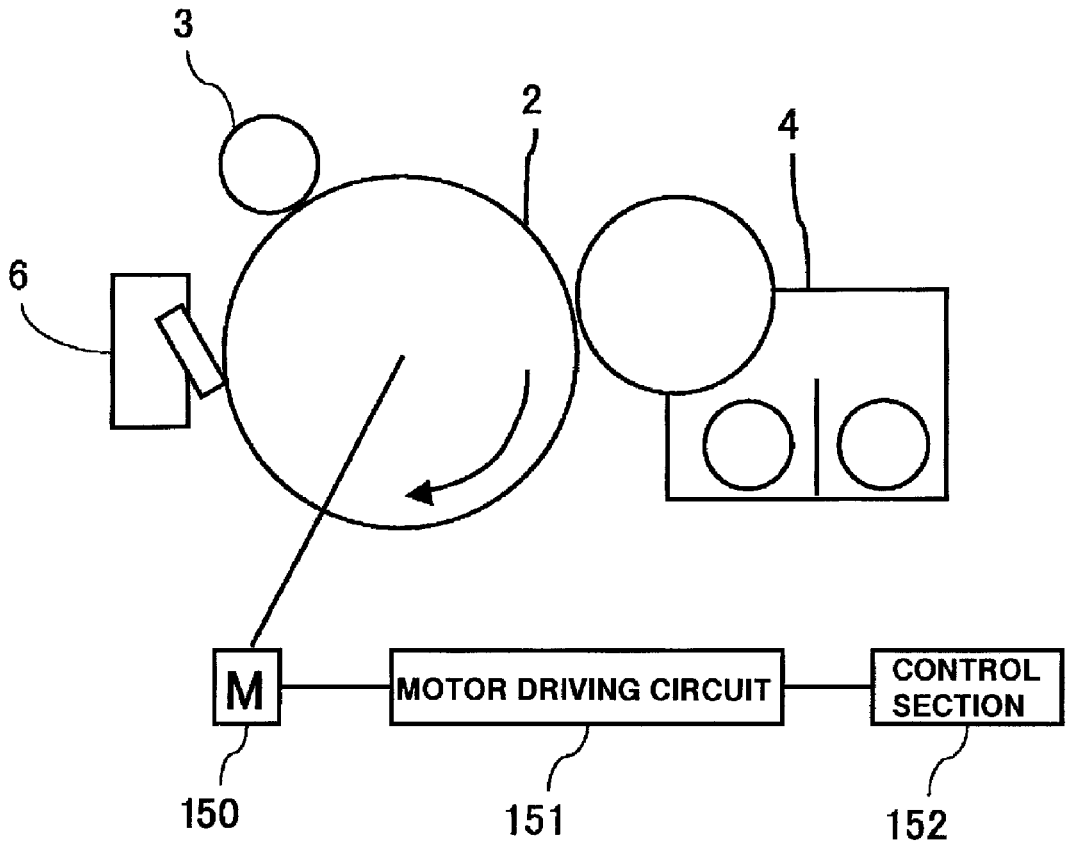
FIG. 9 is a block diagram for describing a manner for detecting a driving torque.

As shown in FIG. 9, the photosensitive drum 2 is rotary driven by a DC servomotor 150 being a motor (driving device); and the DC servomotor 150 is driven by a motor driving circuit 151. A control section 152 being a control unit (controller) has a CPU, memories and the like inside thereof to control respective devices. In order to keep the rotation speed of the DC servomotor 150 constant, the control section 152 detects the speed of the DC servomotor 150 by means of a rotation speed detection device (not shown), whereby the electric current value to be supplied to the DC servomotor 150 from the motor driving circuit 151 is controlled. Furthermore, the control section 152 is provided with units which perform the other control operations in the image forming apparatus. Examples of these units include a changing unit for changing a reference value in response to the value of the driving torque detected, a supply control unit for controlling a toner amount to be supplied to a development unit by means of a toner supply unit, and the like units.

Figure 10:
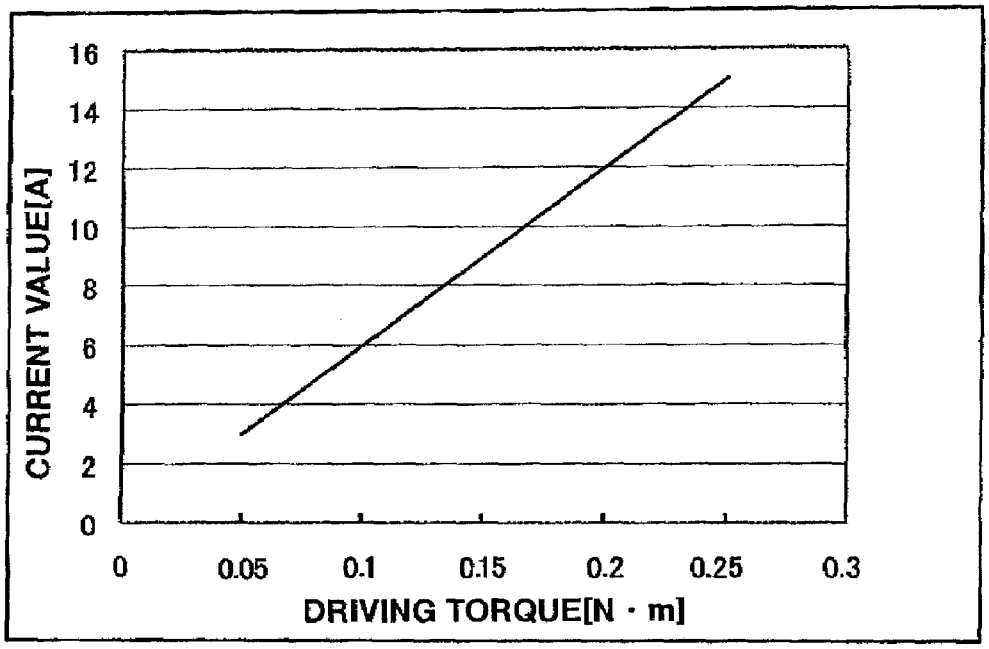
FIG. 10 is a diagram illustrating a relationship between a driving torque and an electric current value of a DC servomotor.

In the case that the driving torque of the photosensitive drum 2 increases, the electric current value to be supplied to the DC servomotor 150 must be increased in order to keep the rotation speed of the DC servomotor 150 constant. As a consequence, the relationship between a motor load current and a driving torque is in a substantially linear proportional relation as shown in FIG. 10. Thus, in the present embodiment, the relation table between the motor load current and the driving torque of FIG. 10 is stored in a memory section (memories, hard disc and the like) in the control section 152, so that when a motor load current value is detected, the driving torque of the photosensitive drum 2 can be calculated. The mechanism as described is used as a driving torque detection unit, and to calculate the driving torque as mentioned herein is referred to as "implementation of detecting operation of a driving torque".

In the image forming apparatus in the present embodiment, the driving torque of the photosensitive drum 2 is detected by means of the above-mentioned units. Concerning the timing of detecting a driving torque in the present embodiment, there is one timing for each the above-mentioned non-image formation cases of preliminary rotation process, paper interval process, and post-rotation process. The reason for detecting a driving torque in non-image formation cases is as follows. Namely, the electric potential Vback is in a uniform condition over the whole region in the main scanning direction and the sub-scanning direction of the photosensitive drum in case of non-image formation. For this reason, the driving torque of the photosensitive drum can be accurately detected always in the same electric potential condition.

On the other hand, the electric potential in the main scanning direction and the sub-scanning direction of the photosensitive drum becomes a non-uniform condition depending on the image pattern to be formed in case of image formation. Hence, it becomes difficult to detect the presence or absence of beads carry over in high precision.

Figure 11:
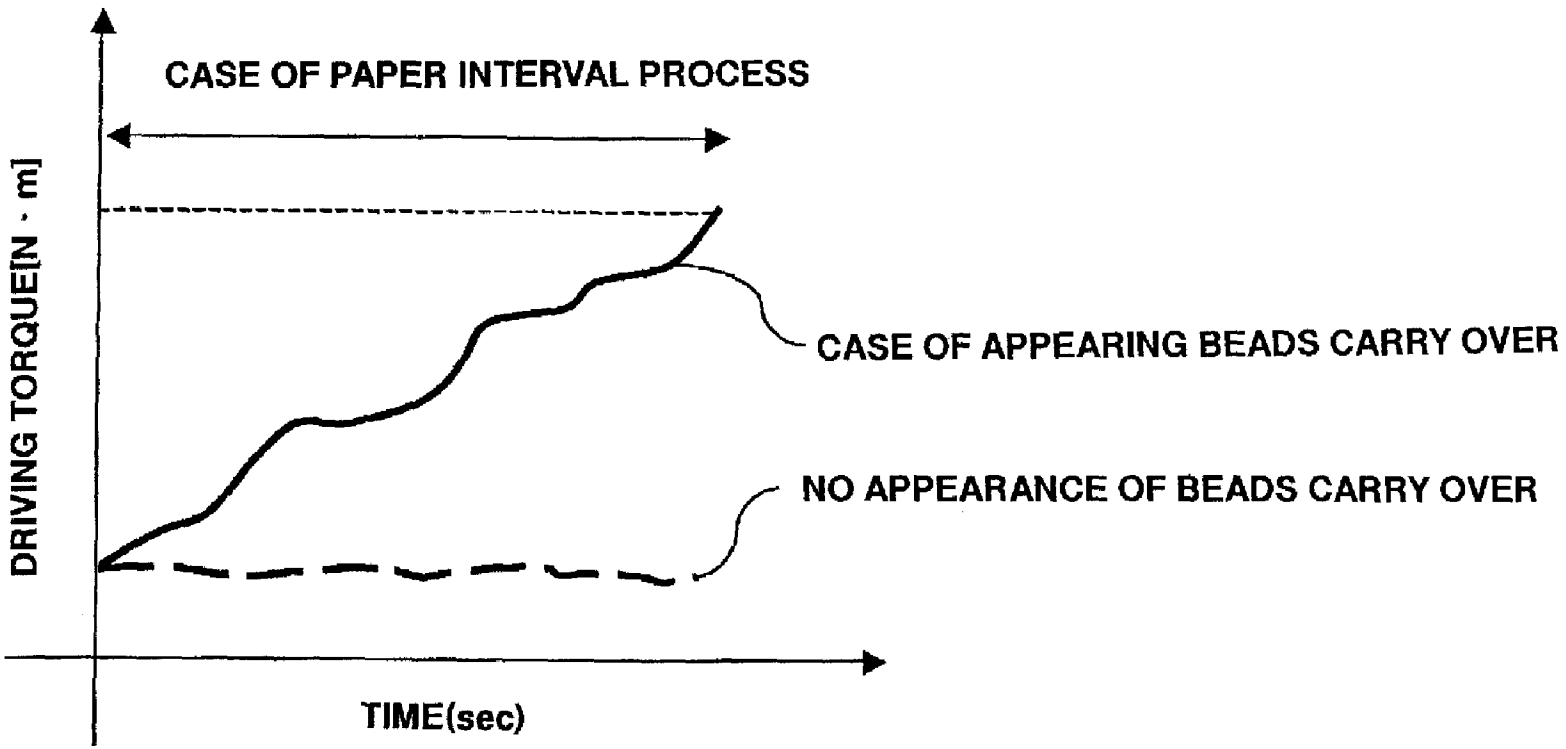
FIG. 11 is a diagram for describing a state of varying the driving torque in the case that beads carry over arises.

FIG. 11 shows the fluctuation transition of driving torque of a photosensitive drum in the case that beads carry over appears actually in a certain paper interval. When the beads carry over arises as shown in FIG. 11, the driving torque of the photosensitive drum rises. In the circumstances, the driving torque in a predetermined period of the respective cases of preliminary rotation process, paper interval process, and post-rotation process is detected. As a result, it is judged that beads carry over appears in the image forming unit in the case that such result that a difference between the maximum value and the minimum value of the driving torque detected in each of the non-image formation regions exceeds a predetermined threshold value (0.02 N.m in the present embodiment) is consecutively obtained a predetermined number of times (consecutive five times of the results in the present embodiment). In this case, the value of the reference signal Vref in the above-mentioned patch detection method is compensated, and the toner density of a developer in a development unit is increased.

Figure 12:
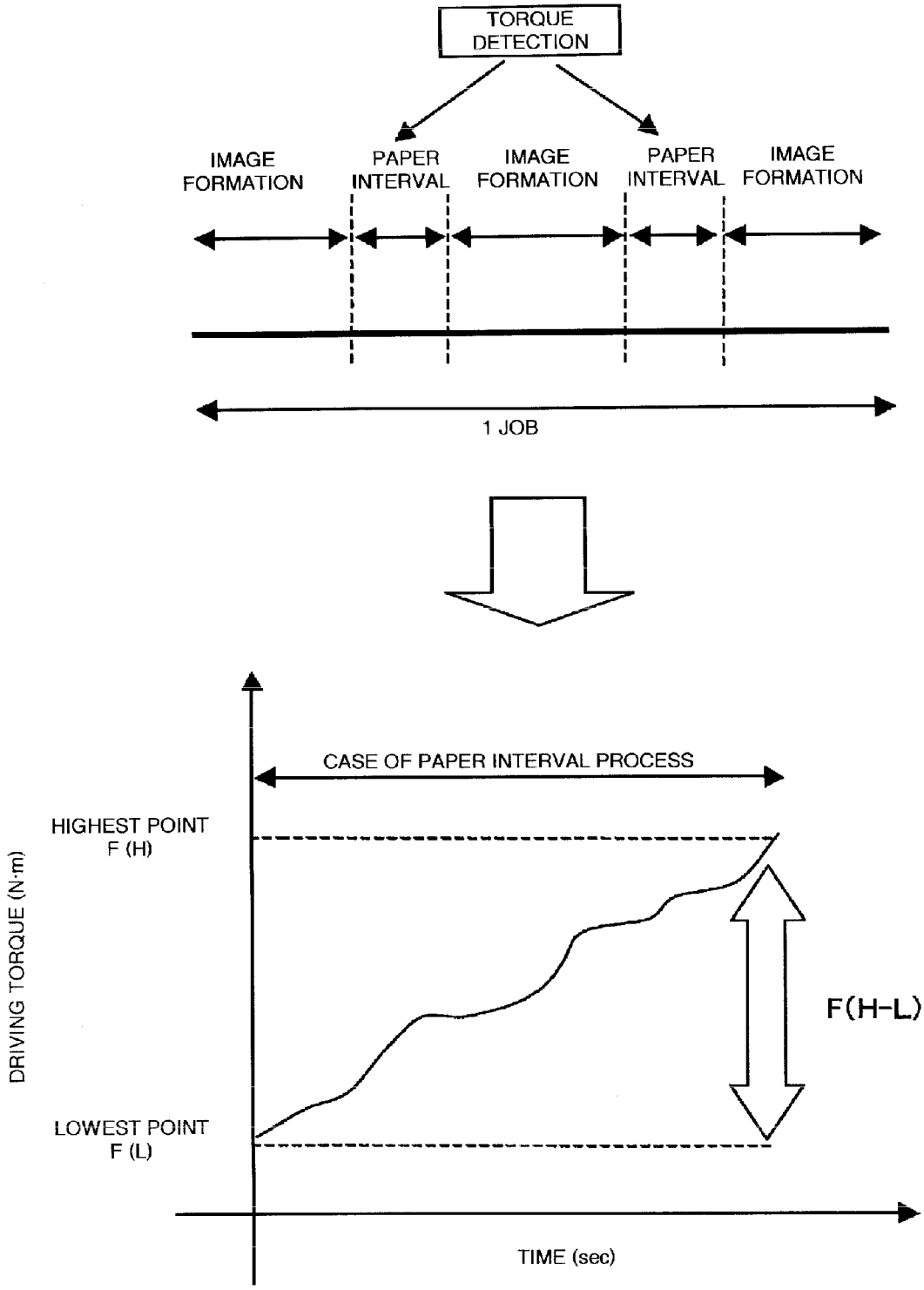
FIG. 12 is a diagram for describing the detection timing of a driving torque and a manner for detecting the driving torque.
Figure 13:
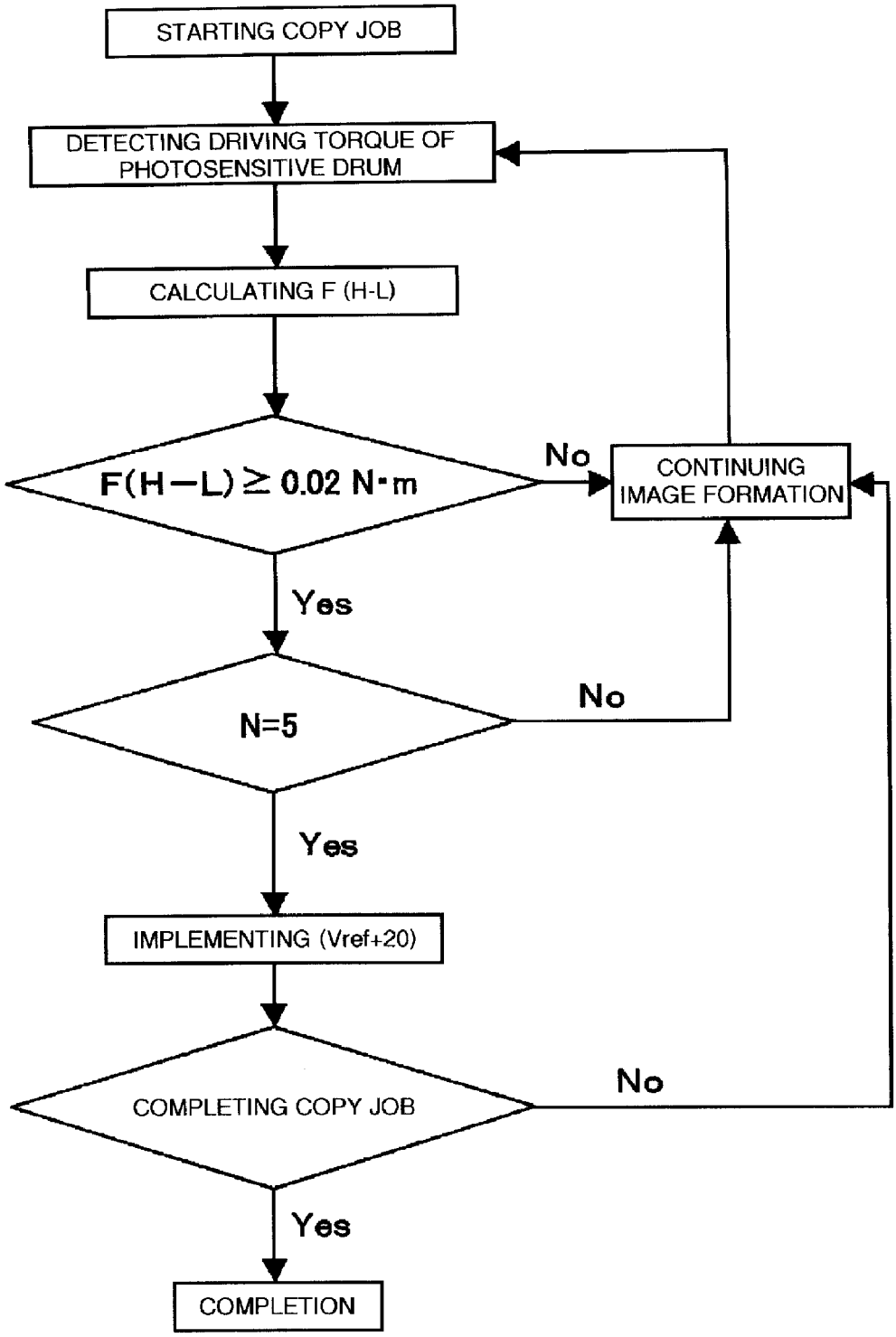
FIG. 13 is a flowchart for compensating a patch reference value Vref in a first embodiment and a third embodiment.

Referring to the diagram of FIG. 12 and the flowchart of FIG. 13, the processes of the torque detection and the compensation of the patch reference signal Vref in a paper interval process are described in detail as an example of a non-image formation region.

First, the motor load current value applied to the DC servomotor 150 in a certain predetermined period of time (0.4 second in the present embodiment) in the case of paper interval process is consecutively measured. From the results obtained, the driving torque of the photosensitive drum 2 is calculated by means of the relational table of FIG. 10. Then, as shown in FIG. 12, a difference F (H-L) between the maximum value F (H) and the minimum value F (L) of the driving torque calculated is obtained. As a consequence, it is judged that there arises no beads carry over in the case that the F (H-L) is 0.02 N.m or less, and the image forming operation is continued as it is. On the other hand, it is judged that there arises beads carry over in the case that such result that the F (H-L) is 0.02 N.m or more is obtained consecutively five times, so that it is adjusted to elevate a value of the reference signal Vref in a patch detection system by 20 levels (corresponding to 0.5% toner density) (Vref+20).

Beads carry over is detected herein by the calculation of the difference F (H-L) between the maximum value F (H) and the minimum value F (L) of the driving torque calculated as shown in FIG. 12. In this case, if the presence or absence of beads carry over is detected by only the absolute value of a driving torque, there is a case where a disadvantage arises. This is because a cause for increasing the absolute value of the driving torque of the photosensitive drum 2 may be derived from factors other than the beads carry over. An example of the factors includes a case where such a condition that a toner is exhausted in a blade portion of the cleaning device 6 continues according to the status of use of an image forming apparatus.

According to the present embodiment, when the difference F (H-L) between the maximum value F (H) and the minimum value F (L) calculated in a non-image formation region is calculated, only the rising amount of the driving torque in the case that beads carry over appears can correctly be detected. Consequently, the presence or absence of beads carry over can be detected in high precision.

In the present embodiment, it is arranged in such that a driving torque is not detected until 10 pieces of image formation are completed after the value of a reference signal Vref is compensated in the case where it is judged that beads carry over appears. This is because a time lag occurs before a toner density increases as a result of toner supply after the compensation of the Vref.

In the present embodiment, it is also arranged in such that the value of a patch reference signal Vref is compensated in every 20 levels in the case that beads carry over arises. However, when the number of times for compensating patch reference signals Vref increases, the toner density rises, whereby there is such a fear that the toner flies in all directions to cause the contamination inside the apparatus. In this respect, even in the case that eight times (corresponding to 4% of toner density) of the compensation of the patch reference signal Vref are made, when it is judged that beads carry over arises, it is concluded that the image formation unit is in an abnormal state, and the fact thereof is reported (indication of error). In this case, it may be arranged in such that the image forming operation is stopped.

As mentioned above, the value of the reference signal Vref may be compensated to increase the toner density in a development device in the case that beads carry over is detected, whereby the charging amount of a carrier may be reduced to prevent beads carry over.

In the above description, although the driving torque detection and the reference signal Vref compensation in the case of paper interval process are mentioned, the manners of the driving torque detection and the reference signal Vref compensation in the case of paper interval process are the same as that in also the cases of preliminary rotation process and post-rotation process. Namely, the driving torque is detected within a certain predetermined period of time (0.4 second in the present embodiment) in cases of non-image formation (the cases of preliminary rotation process, paper interval process, and post-rotation process). Then, it is judged that beads carry over arises in the case that such a result that the F (H-L) is 0.02 N.m or more is consecutively obtained five times. As a consequence, the value of the reference signal Vref in the patch detection system is increased by 20 levels.

As mentioned above, the presence or absence of beads carry over is judged by detecting the driving torque of the photosensitive drum 2 in cases of the non-image formation in the present embodiment. As a result, the reference value of the reference signal in a patch detection system is compensated in the case that beads carry over appears, whereby the toner density makes adequate. Thus, the charging amount of a carrier is reduced, so that the beads carry over can be prevented. Consequently, a stabilized image forming apparatus can be provided without accompanying the deterioration in image quality or the decline in life of a photosensitive drum or a cleaning member.

In the present embodiment, although a video count system is applied together with a patch detection system as a toner density control system of a developer in the development container 80, the invention is not limited thereto. For example, the toner density control system may be a light detection system wherein changes in the light reflection density determined from the quantity of reflected light in the case when a light is illuminated on a developer. Furthermore, an inductance detection system for measuring changes in the magnetic permeability of a developer may also be applied. In this case, the reference value of the reference signal in a toner density detection unit is compensated in the case that beads carry over arises depending on the detection result of a driving torque in the photosensitive drum 2, and accordingly, the present embodiment may be applied in also the control for making the toner density adequate.

In the present embodiment, although it is judged that beads carry over appears in the case that such a result that the difference F (H-L) between the maximum value F (H) and the minimum value F (L) of the driving torque calculated is equal to a certain threshold value or more is consecutively obtained five times, the invention is not limited thereto. The reason for setting the result of consecutive five times is in that erroneous detection of the presence or absence of beads carry over is prevented in the case that the driving torque increases due to a foreign matter or the like which exists scarcely on a photosensitive drum, whereby the detection accuracy is elevated. Accordingly, if the detection accuracy may be elevated, the invention is not particularly limited to the above-described number of times.

In the present embodiment, although beads carry over detecting operation is conducted in non-image formation zone of the cases of preliminary rotation process, paper interval process, and post-rotation process, but the invention is not limited thereto. For instance, beads carry over detecting operation may be made in such a manner that a Vback electric potential is formed on the whole region of a photosensitive drum as a particular sequence after suspending temporary a copy operation during the copy job. Moreover, it may be arranged in such that periods of time for the preliminary rotation process, the paper interval process, and the post rotation process are made to be periodically longer than that in a usual case, whereby the Vback region is set up longer to conduct a beads carry over detecting operation.

In the present embodiment, the constitution of the image forming apparatus is not limited to that shown in FIG. 1, but it is applicable for, for example, the constitution of a direct transfer system wherein a toner image is transferred directly from a photosensitive drum to a recording material without an intermediate transfer member.

It is not intended to limit the scope of the invention by only the sizes, the materials, the figures of the components of the image forming apparatus, and the relative positions of these components described in the present embodiment so far as there is not a particularly specific description thereto.

Second Embodiment

The second embodiment of the invention is described by referring to the accompanying drawings. The basic constitution and the operations of the image forming apparatus of the present embodiment are the same as that of the first embodiment, and accordingly, the components having the same or corresponding functions or constitutions as or to those of the first embodiment are designated by the same reference characters and the detailed descriptions therefor are omitted, and the distinguishing points to the present embodiment are described hereunder.

The first embodiment is constituted in such that the driving torque of the photosensitive drum 2 is detected, and when it is judged from the detection result that there is beads carry over, a reference value of the reference signal in a patch detection system or a toner density detection system is compensated, whereby it makes a toner density adequate to suppress the beads carry over.

On the other hand, the present second embodiment is constituted in such that the driving torque of a photosensitive drum 2 is detected, and when it is judged from the detection result that there is beads carry over, the Vback electric potential is compensated, so that the beads carry over is suppressed. In the following, the details thereof are described.

In the present embodiment, the charging voltage (Vd electric potential) on the surface of the photosensitive drum 2 is −500 V, a development bias voltage (Vdc electric potential) as an applied voltage to be applied to a development sleeve 61 is −300 V, and a Vback electric potential is 200 V in case of non-image formation as in the first embodiment. First, the driving torque in cases of non-image formation (the cases of preliminary rotation process, paper interval process, and post-rotation process) are detected. Then, it is judged whether or not each of the differences between the maximum values and the minimum values of the driving torque detected in the respective non-image forming regions exceeds a certain threshold value five times. In the case where the difference exceeds the threshold value, it is concluded that there is a beads carry over in an image forming unit, and the Vback electric potential is compensated.

Figure 14:
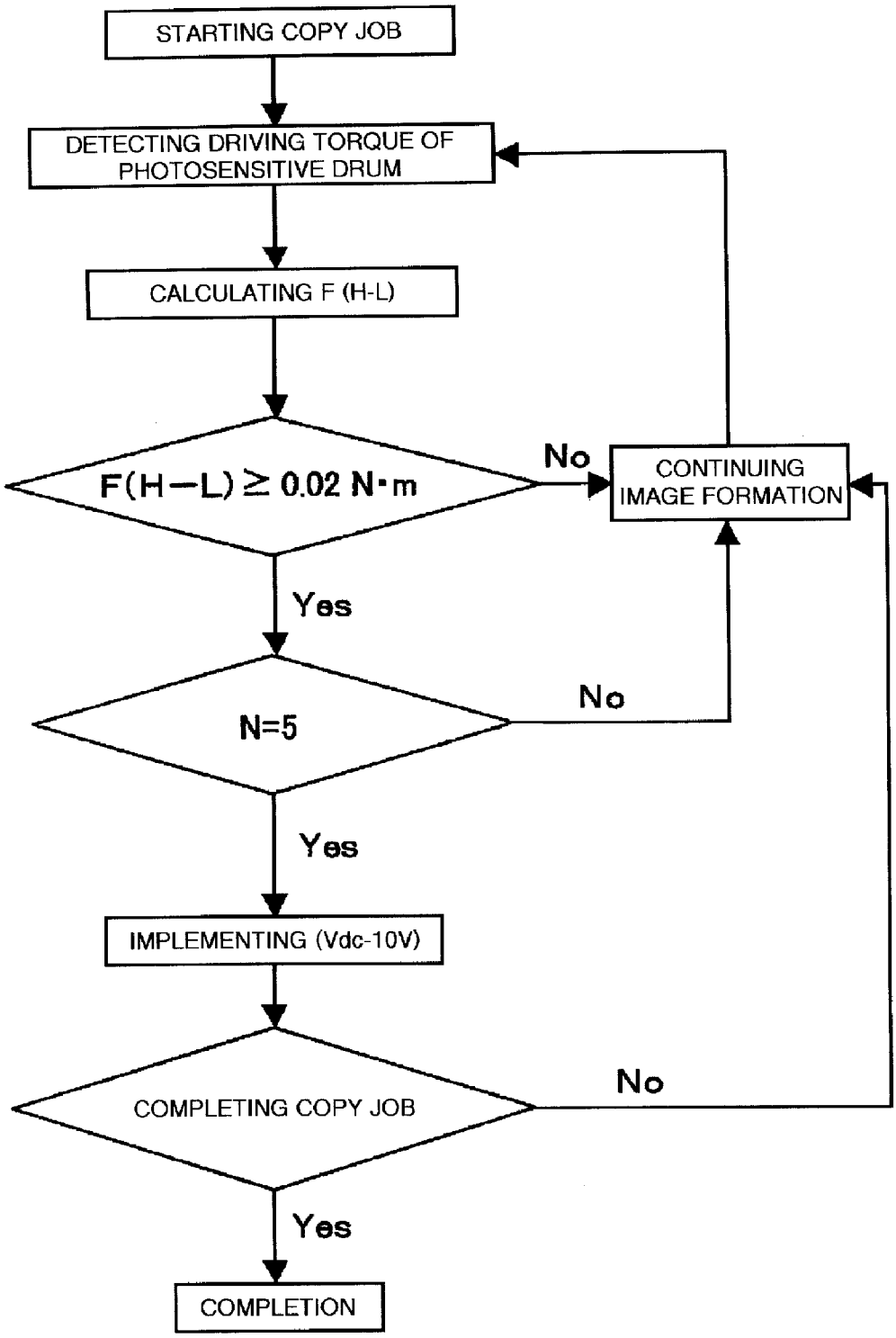
FIG. 14 is a flowchart for compensating a Vback electric potential in a second embodiment.

The embodiment is described by referring to the flowchart shown in FIG. 14. First, a motor load current value applied to a DC servomotor 150 in a certain predetermined period of time (0.4 second in the present embodiment) in the case of paper interval process is consecutively measured, and the driving torque of the photosensitive drum 2 are calculated by the relation table of FIG. 10 from the results measured. The differences F(H-L) between the maximum values F (H) and the minimum values F (L) of the driving torque calculated are calculated. In the case that the F (H-L) is less than 0.02 N.m, it is judged that there is no beads carry over, and the image forming operation is continued as it stands. On the other hand, it is judged that there is beads carry over in the case that such result that the F (H-L) is 0.02 N.m or more is consecutively obtained five times, and the development bias voltage Vdc applied to the development sleeve 61 is reduced by 10 V. In other words, the development bias voltage Vdc is changed from −300 V to −310 V, whereby the Vback electric potential reduced from 200 V to 190 V, so that beads carry over can be suppressed.

In the case that the beads carry over is detected as mentioned above, the beads carry over can be prevented by lowering the Vback electric potential. In the above description, although the driving torque detection and the compensation of the Vback potential in the case of paper interval process is described, the manner for the driving torque detection and the compensation of the Vback in cases of preliminary rotation process and post-rotation process is also the same as that of the case of paper interval process. Namely, driving torque are detected in each certain period of time in the cases of preliminary rotation process, paper interval process, and post-rotation period, and it is judged that there is beads carry over in the case that such result that the F (H-L) is 0.02 N.m or more is consecutively obtained five times. In this case, the development bias voltage Vdc applied to the development sleeve 61 is compensated by 10 V.

In the present embodiment, although the Vback electric potential is compensated by every 10 V in the case that beads carry over is detected, there is a fear of causing toner fog in the case that the number of times in compensating the Vback electric potential increases, because the Vback electric potential becomes insufficient on the contrary. In this respect, even in the case where the Vback electric potential is compensated seven times (corresponding to 130 V of the Vback electric potential), and there is still such judgment that beads carry over arises in the present embodiment, it is concluded that the image formation unit is in an abnormal state and an error indication is output.

As mentioned above, the presence or absence of beads carry over is judged by detecting driving torque of the photosensitive drum 2 in case of non-image formation; and the Vback electric potential is compensated in the case that it is judged that beads carry over arises, so that the beads carry over can be prevented. As a consequence, a stabilized image forming apparatus which does not result in deterioration in image quality or decline in life of a photosensitive drum or a cleaning member can be provided.

In the present embodiment, although a development bias voltage Vdc is altered in case of compensating a Vback electric potential, the Vback electric potential may be altered by altering the charging potential (Vd) of a photosensitive drum. Namely, it is judged that there arises beads carry over in the case that such result that the F (H-L) is 0.02 N.m or more is consecutively obtained five times, and the applied voltage applied to a charging roller 3 is elevated by 10 V, so that the charging potential Vd of the photosensitive drum 2 changes from −500 V to −490 V. Thus, it makes the Vback electric potential to reduce to 190 V from 200 V, so that beads carry over can be suppressed as in the case where the Vdc is compensated.

Third Embodiment

The third embodiment of the present invention is described by referring to the accompanying drawings. The basic constitution and the operations of the image forming apparatus of the present embodiment are the same as that of the above-mentioned embodiments, and accordingly, the components having the same or corresponding functions or constitutions as or to those of the above embodiments are designated by the same reference characters and the detailed descriptions therefor are omitted, and the distinguishing points to the present embodiment are described hereunder.

In the above-mentioned embodiments, the Vback electric potential in case of image formation is treated by the same manner as the Vback electric potential in case of non-image formation such as the cases of preliminary rotation process, paper interval process, and post-rotation process. For this reason, there is such a case that beads carry over has already arisen as to the image copied immediately before detecting the beads carry over in even the case that the arising of beads carry over was detected by the methods of the above-mentioned embodiments, and further various compensating operations have been implemented in order to suppress the beads carry over. In such case, there is a fear of resulting in deterioration of image quality.

In the present embodiment, it is arranged in such that the Vback electric potential in case of non-image formation wherein driving torque of the photosensitive drum 2 are detected is made to be higher than that in case of image formation, whereby a condition wherein beads carry over arises easily in case of the non-image formation is prepared. In this condition, it is previously detected by the use of a non-image formation region whether or not there is in a condition in which beads carry over arises easily. As a consequence, the appearance of beads carry over in case of image formation can be suppressed from occurring. The details thereof are described hereinbelow.

Figure 15:
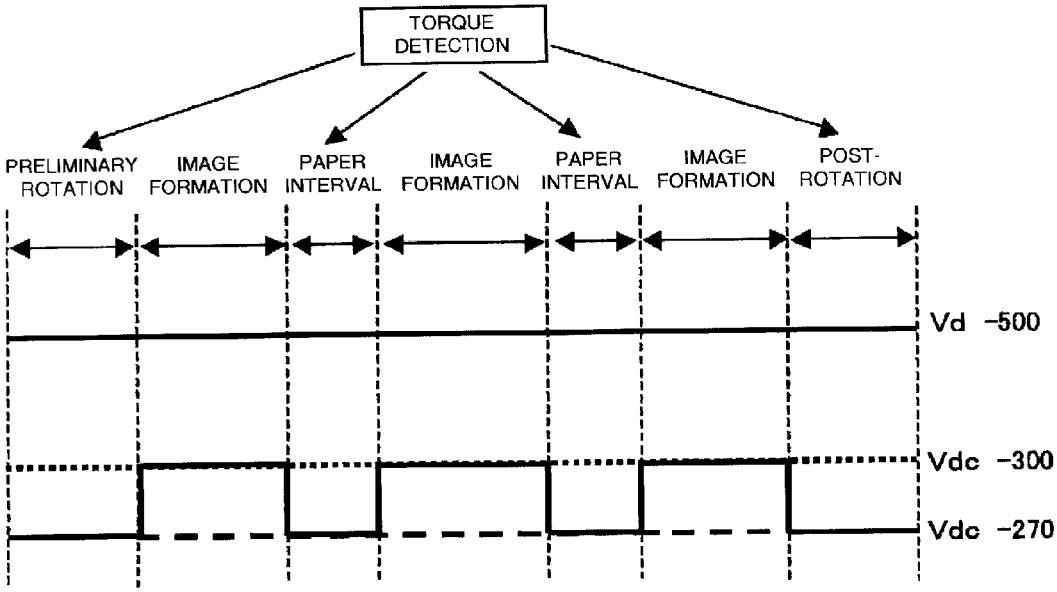
FIG. 15 is a diagram for describing a photosensitive drum electric potential Vd and a development potential Vdc in case of normal image formation and in case of non-image formation in the second embodiment.

As shown in FIG. 15, in the present embodiment, the Vback electric potential in case of image formation is 200 V, and the Vback electric potential in cases of non-image formation such as the cases of preliminary rotation process, paper interval process, and post-rotation process is made to be 230 V by changing a development bias voltage Vdc. As a result, the condition is in such that beads carry over arises more easily in case of non-image formation than in case of image formation.

As in the flowchart shown in FIG. 13 of the first embodiment, the motor load current value applied to a DC servomotor 150 in a certain predetermined period of time (0.4 second in the present embodiment) is measured in case of non-image formation. The driving torque of the photosensitive drum 2 are calculated by means of the relation table in FIG. 10 from the results measured, and the differences F (H-L) between the maximum values F (H) and the minimum values F (L) of the calculated driving torque are calculated.

In this condition, it is judged that there is no beads carry over in the case that the F (H-L) is less than 0.02 N.m, and the image forming operation continues as it is. On the other hand, it is judged that there arises beads carry over in the case that such result that the F (H-L) is 0.02 N.m or more is obtained consecutively five times, so that it is adjusted to elevate a value of the reference signal Vref in a patch detection system by 20 levels (corresponding to 0.5% toner density) (Vref+20).

As mentioned above, a condition wherein beads carry over arises more easily in case of non-image formation than in case of image formation is prepared in the present embodiment. In this condition, it is previously detected by the use of a non-image formation region whether or not there is in a condition in which beads carry over arises easily. As a consequence, the appearance of beads carry over in case of image formation can be suppressed from occurring.

In the present embodiment, although the driving torque of the photosensitive drum 2 are calculated by measuring continuously the motor load current values applied to the DC servomotor 150, the invention is not limited thereto. For instance, it may be arranged in such that at least any one of the input voltage or the power consumption of the DC servomotor 150 is detected or measured, and the driving torque of the photosensitive drum 2 are calculated from the results measured.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-071729, filed Mar. 20, 2007, which is hereby incorporated by reference herein in its entirety.

What is claimed is:

1. An image forming apparatus, comprising:

an image bearing member on which an electrostatic image is formed;

a development device which allows a developer containing a toner and a carrier to be supported on a developer support, whereby the electrostatic image is developed to form a toner image;

an image density detection device which detects a density of the image formed with the toner;

a supply device which supplies the toner to the development device based on a result of detection by the image density detection device;

a cleaning device provided in contact with the image bearing member to clean a surface of the image bearing member;

a driving device which drives the image bearing member;

a driving torque detection device which detects a driving torque in a case of driving the image bearing member; and a controller which controls a toner density of the developer in the development device by the supply device in response to a value of the driving torque so as to suppress a transition of the carrier to the image bearing member.

2. The apparatus according to claim 1, wherein the driving torque detection device detects a maximum value and a minimum value of the driving torque in a predetermined period of time in a driving torque detecting operation, and wherein the controller increases the toner density of the developer in the development device in a case that a difference between the maximum value and the minimum value exceeds a predetermined threshold value.

3. The apparatus according to claim 1, wherein the image density detection device is constituted so as to detect a quantity of a reflected light in a case when a light is illuminated on a reference toner image.

4. An image forming apparatus, comprising:

an image bearing member on which an electrostatic image is formed;

a development device which allows a developer containing a toner and a carrier to be supported on a developer support, whereby the electrostatic image is developed to form a toner image;

a toner density detection device which detects a toner density of the developer in the development device;

a supply device which supplies the toner to the development device based on a result of detection by the toner density detection device;

a cleaning device provided in contact with the image bearing member to clean a surface of the image bearing member;

a driving device which drives the image bearing member;

a driving torque detection device which detects a driving torque in a case of driving the image bearing member; and a controller which controls the toner density of the developer in the development device by the supply device in response to a value of the driving torque so as to suppress a transition of the carrier to the image bearing member.

5. The apparatus according to claim 4, wherein the driving torque detection device detects a maximum value and a minimum value of the driving torque in a predetermined period of time in a driving torque detecting operation, and wherein the controller increases the toner density of the developer in the development device in a case that a difference between the maximum value and the minimum value exceeds a predetermined threshold value.

6. The apparatus according to claim 4, wherein the toner density detection device is constituted so as to detect a magnetic permeability of the developer in the development device, or a quantity of the reflected light in a case when a light is illuminated on the developer in the development device.

7. An image forming apparatus, comprising:

a charging device which charges an image bearing member;

an exposure device which exposes a region charged in the image bearing member being charged by the charging device to form an electrostatic image;

a development device which allows a developer containing a toner and a carrier to be supported on a developer support, and which provides an electric potential difference between the developer support and the electrostatic image, whereby the electrostatic image is developed to form a toner image;

a cleaning device provided in contact with the image bearing member to clean a surface of the image bearing member;

a driving device which drives the image bearing member;

a driving torque detection device which detects a driving torque in a case of driving the image bearing member; and a controller which drives the image bearing member while providing a predetermined electric potential difference between the region charged in the image bearing member and the developer support in case of non-image formation, conducts a driving torque detecting operation with respect to the image bearing member by the driving torque detection device, and changes the electric potential difference between the region charged in the image bearing member and the developer support in a case of image formation in response to a value of the driving torque so as to suppress a transition of the carrier to the image bearing member.

8. The apparatus according to claim 7, wherein the driving torque detection device detects a maximum value and a minimum value of the driving torque in a predetermined period of time in a driving torque detecting operation, and wherein the controller reduces the electric potential difference between the region charged in the image bearing member and the developer support in the case of image formation in a case that a difference between the maximum value and the minimum value exceeds a predetermined threshold value.

9. The apparatus according to claim 1 or 4, further comprising:

a charging device which charges the image bearing member; and an exposure device which exposes a region charged in the image bearing member being charged by the charging device to form an electrostatic image, wherein the controller makes the electric potential difference between the region charged in the image bearing member and the developer support to be higher in a case of non-image formation than the electric potential difference between the region charged in the image bearing member and the developer support in a case of image formation, in the case that a driving torque detecting operation is conducted.

10. The apparatus according to claim 7, wherein the controller makes the electric potential difference between the region charged in the image bearing member and the developer support to be higher in the case of non-image formation than the electric potential difference between the region charged in the image bearing member and the developer support in the case of image formation, in the case that the driving torque detecting operation is conducted.

11. The apparatus according to claim 1, 4 or 7, wherein the driving device comprises a motor which keeps a rotating speed constant, and wherein the driving torque detection device detects a driving torque of the image bearing member by detecting at least one of a load current, an input voltage, and an electric power consumption of the motor.

12. The apparatus according to claim 1, 4 or 7, wherein the driving torque detection device detects a maximum value and a minimum value of the driving torque within a predetermined period of time in a driving torque detecting operation, and wherein the controller reports an effect that the apparatus is in an abnormal state, when a result that the difference between the detected maximum value and the detected exceeds a predetermined threshold value is consecutively repeated for a predetermined number of times.

* * * * *